US006038971A

United States Patent [19]

Fischer

[11] Patent Number: 6,038,971

[45] Date of Patent: Mar. 21, 2000

[54] METHOD AND APPARATUS FOR PRODUCING A SCREEN-PRINTING STENCIL

[75] Inventor: Hannes Fischer, Worgl, Austria

[73] Assignee: Schablonentechnik Kufstein Aktiengesellschaft, Kufstein, Austria

[21] Appl. No.: 09/135,583

[22] Filed: Aug. 18, 1998

[30] Foreign Application Priority Data

Aug. 18, 1997 [EP] European Pat. Off. ..... 97 114 203

[51] Int. Cl.[7] ..... B41M 1/12

[52] U.S. Cl. ..... 101/129; 101/128.4

[58] Field of Search ..... 101/114, 127, 101/127.1, 128.1, 128.21, 128.4, 129; 427/282

[56] References Cited

U.S. PATENT DOCUMENTS 5,662,821 9/1997 Ruckl ..... 291/121.67
5,819,653 10/1998 McCue ..... 101/128.4
5,878,662 3/1999 McCue ..... 101/128.4

FOREIGN PATENT DOCUMENTS 0 329217 8/1989 European Pat. Off. .
0 714766 6/1996 European Pat. Off. .
0 728577 8/1996 European Pat. Off. .
2 303535 8/1973 Germany .
94/04361 3/1994 WIPO .

*Primary Examiner*—Ren Yan
*Attorney, Agent, or Firm*—Birch, Stewart, Kolasch & Birch, LLP

[57] ABSTRACT

In the production of a screen-printing stencil, a covering layer is applied to only some regions of a fine-mesh screen in accordance with a desired printing pattern. In this case, for the application of the covering layer, the screen is closed on the rear side by a support, so that the passage of covering liquid through the screen is prevented, which leads to qualitatively high-grade patterns.

22 Claims, 3 Drawing Sheets

METHOD AND APPARATUS FOR PRODUCING A SCREEN-PRINTING STENCIL

BACKGROUND OF THE INVENTION

1. Field of the Invention

The invention relates to a method of producing a screen-printing stencil in which a covering layer is applied to only some regions of a fine-mesh screen. The stencil printing device includes a bearing device, a coating device, and an elastic hollow body.

2. Description of the Background Art

A method of producing a screen-printing stencil is already generally known, in which a covering layer is applied to only some regions of a fine-mesh screen in accordance with a desired printing pattern.

However, it has been shown that screen openings can often not be filled completely by a liquid substance that is used for forming the covering layer. In other situations where the edge of the printing pattern is intended to end between two screen webs, the covering layer may not be built up to a sufficient extent. One cause of this is the fact that the liquid substance does not adhere to the structure that are already present but passes through the screen. This leads to faulty printing patterns on the stencil and hence ultimately to prints which are of reduced quality.

SUMMARY OF THE INVENTION

The invention is based on the object of developing a method of the type mentioned at the beginning such that printing patterns may be produced more accurately on the stencil. Furthermore, it is an object of the invention to specify a device suitable for this.

The method according to the invention of producing a screen-printing stencil, in which a covering layer is applied to only some regions of a fine-mesh screen in accordance with a desired printing pattern, is characterized by the fact that, for the application of the covering layer, the screen is closed on the rear side by a support.

This support prevents the liquid substance that is used to build up the covering layer from passing through the screen. As a result, the screen openings may always be filled completely, specifically even when the screen has a relatively course mesh. Furthermore, edges of the covering layer which end in the region between two screen webs are supported by the support with the result that they can be relatively projecting. The covering layers produced in this way allow the printing patterns to be modeled better, which leads to a higher-grade quality print.

All of the common screens can be used for forming stencils such as plastic screens, screens made of wire fabric or screens produced by electroplating, nickel screens, and the like. After the application of the covering layer to the screen, the support is removed once more from them, so that the finished screen-printing stencil is present. In this case, care must be taken that the material used for forming the covering layer does not adhere too strongly to the support or does not adhere at all in order to avoid damage to the applied covering layer when separating the screen and support. In this case, a material which only has a low affinity with the material of the support is selected for the covering layer.

According to one embodiment of the invention, the separation of screen and support is effected after risk of damaging the covering layer when removing the support from the screen is thus reduced. In this case, the type of solidification of the covering layer is effected according to the material used for forming the covering layer.

The material for forming the covering layer can be, for example, a viscid liquid, for example an aqueous emulsion of a synthetic resin lacquer, an aqueous suspension of pigment or wax. However, molten metal or a molten metal alloy, for example Wood's metal, is also considered as the liquid substance for forming the covering layer. Wood's metal has a relatively low melting point and can therefore be used in particular in the case of metallic screens. The use of paints or the use of ink for forming the covering layers is also possible.

The solidification of these materials is dependent on the type of composition of the materials. If a polymerizable lacquer is employed then the latter may be cured or cross-linked by heating and/or exposing using radiation of suitable wavelength. In the case of paints or inks or in the case of wax, the covering layer only needs to be heated. Metals or metal alloys can be solidified by cooling. Annealing steps could follow this if appropriate.

In another embodiment of the invention, the covering layer may be sprayed on to the screen. This also applied to specific metals or metal alloys (Wood's metal). However, the spreading of appropriate materials onto the screen for forming the covering layer is also possible. However, the latter can also be applied to the screen by a transfer-printing method such as using liquid plastics, lacquers, paints and inks. Last but not least, the covering layer may also be applied to the screen by a doctoring or dipping method, if specific regions of the screen have previously been treated in such a way that no covering material remains adhering to them. Before carrying out the doctoring or dipping method, these regions could be greased.

The screens used can quite generally be flat screens, cylindrical screens or screens of any other arbitrary shape. What is important is only that they may be closed on the rear side by the support. For the purpose of coating with the covering layer, a flat shape, for example into a cylindrical shape, by being placed onto the circumferential surface of a cylinder and then treated.

Rigid or elastic supports are used as the support, which for example can also be pressed against the rear side of the screen. In the case of a screen cylinder, the support may be an expandable hollow body, which is arranged in the interior of the screen cylinder and may be pressed by expansion against the inner circumferential surface of the screen cylinder. After the covering layer has been applied, the hollow body is evacuated once more, as a result of which it is detached from the screen cylinder.

The material for the support can be selected in accordance with the material of the screen and that of the covering layer. Thus, for example, a support may comprise metal, rubber, unvulcanized rubber, plastic and the like. Natural materials, such as wood, stone, glass, etc. are also possible. Certain materials are ruled out, however, if the support has to be elastic.

A device according to the invention for producing a printing stencil has at least the following: a bearing device for the rotatable mounting of a hollow cylinder about its longitudinal axis; a coating device for the application of a covering layer to the outer circumferential surface of the hollow cylinder, as defined by a pattern; and an elastic hollow body, which can be pressed by expansion against the inner circumferential surface of the hollow cylinder.

When using a device of this type, it is possible to coat not only screens with a covering layer in accordance with the method of the present invention, but also hollow cylinders which have a closed circumferential surface. These may be, for example, flexographic printing forms which have a continuous photoelastomer layer on their outer circumferential surface. This can be covered as defined by a pattern, in order subsequently to be exposed. However, a hollow cylinder may also be metallic cylinder, which is covered with an insulating layer, as defined by a pattern, in order subsequently to apply a metal screen to it by way of electroplating. Other hollow cylinders can also be coated as defined by a pattern, for example screen cylinders closed by a continuous lacquer layer, the lacquer layer being photosensitive. After coating, the cylinder is exposed in order to expose screen openings, as defined by a pattern, by means of a subsequent development operation.

According to another embodiment of the invention, the hollow body may be designed as a tube that can be inflated in the radial direction of the hollow cylinder. The hollow body is placed from the inside against the wall of the hollow cylinder and thus stabilizes the concentric running of the hollow cylinder. If the hollow cylinder is a screen to be coated, then the screen is at the same time closed at its rear side by the tube.

Alternatively, the hollow cylinder may also be designed as a sleeve that can be expanded in the radial direction. Here it may be a metal sleeve with an extremely thin wall, which is still partly elastic in the radial direction, in order to be pressed against the inner circumferential surface of the hollow cylinder. The concentric running of the hollow cylinder can also be stabilized by means of the sleeve, and a screen can be closed on the inside.

The hollow cylinder may be provided separately from the bearing device. The bearing device can be introduced into the hollow cylinder and pressed against the inner wall of the said hollow cylinder. For example, air can be let in at a positive pressure into a tube that is closed at the end. Only after the tube has been placed against the inner circumferential surface of the hollow cylinder is the latter inserted into the bearing device of the device according to the invention.

However, the hollow body may also be part of the bearing device. The hollow body may take the form of an inflatable cylindrical clamping roll, which is rotatably mounted and onto which the hollow cylinder is pushed.

The cylindrical clamping roll may be inflated by a compressed-air source, which may be part of the device according to the invention. The compressed-air source may be a blower which, if appropriate, is also able to compensate for flow losses and ensures that a circular cross-section of the hollow body or hollow cylinder is maintained.

The coating device itself may have a coating station which can be displaced parallel to the longitudinal axis of the hollow cylinder. A liquid covering medium is then applied to the stencil via the coating station in order to produce the covering layer. In this case, the coating station may be one which has one or more nozzles in order to spray on the coating layer. This is effected while rotating the hollow cylinder about its longitudinal axis. With simultaneous displacement of the coating station in the longitudinal direction of the hollow cylinder. The nozzles may be pressure-controlled, piezoelectricity excited or electrostatic nozzles. Bubble-jet nozzles may also be used.

However, a transfer-printing roll that is situated parallel to the hollow cylinder can also be used as the coating station by means of which a liquid covering layer is transferred to the hollow cylinder. If the hollow cylinder and transfer-printing roll run parallel to each other, they are rotated appropriately and come into contact with each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
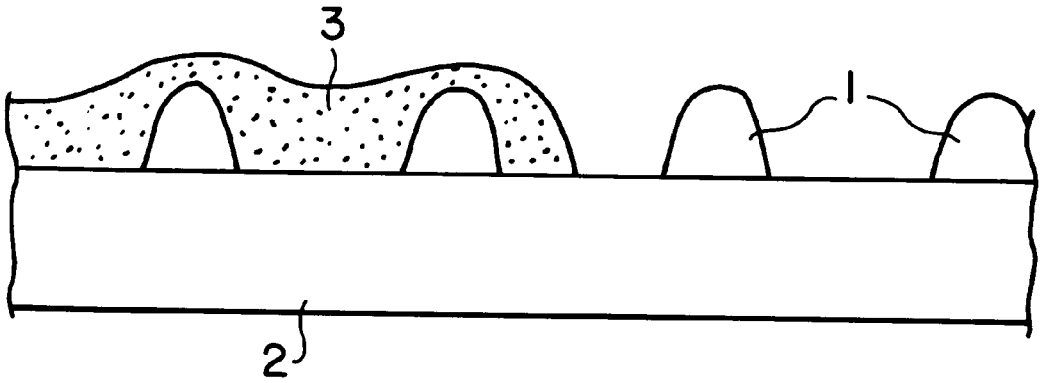
FIG. 1 shows an enlarged longitudinal section through a screen-printing stencil supported by a support.

FIG. 1 shows the principle on which the invention is based. A screen 1 that is to be coated is firstly placed onto a support 2, specifically in such a way that it is in overall contact with the support 2. A covering layer 3 is subsequently applied to the screen 1, as defined by a pattern. The covering layer 3 completely or partially fills regions between webs of the screen 1. Since the screen 1 rests with its underside on the support 2, any penetration of the covering layer 3 through the screen openings is prevented by the support 2. This ensures that the pattern is also actually transferred to the screen 1 in its originally desired form, and that, for example, no breaks remain at the edge of the pattern, nor any faulty openings remain in the central regions of the pattern.

The closing of the screen openings by the support 2 that rests against the rear side is more advantageous. With larger screen openings, a thinner material is used for forming the covering layer 3 or a thinner covering layer 3 itself. In this case, the support 2 acts as a support for the covering layer 3 and is only removed from the screen 1 when there is no longer any risk that the covering layer 3 will be damaged by this.

Figure 2:
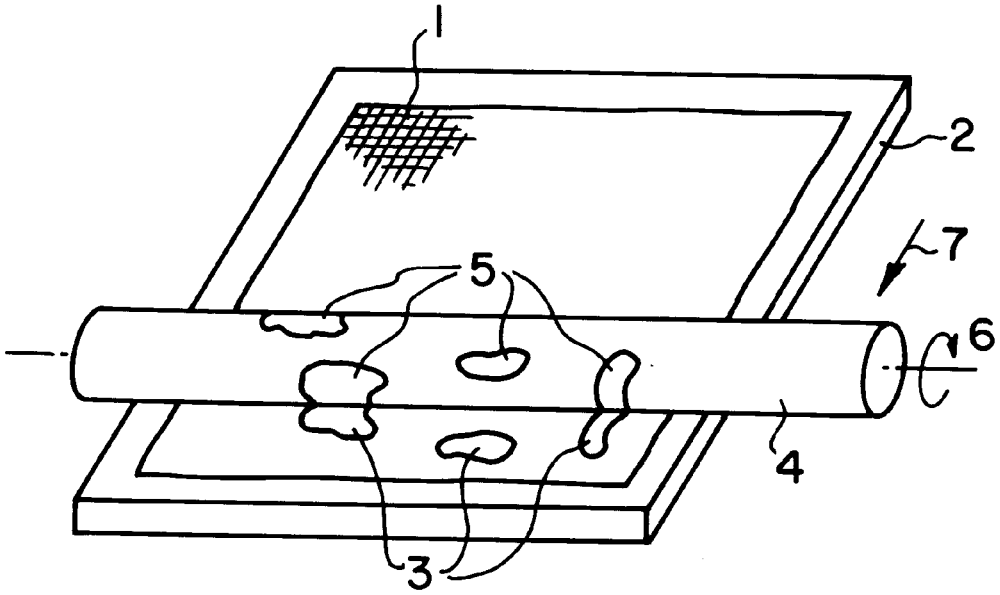
FIG. 2 shows a method step according to the invention for the application of a covering layer, as defined by a pattern, to a flat screen, which is situated on a flat support.

FIG. 2 shows one possibility as to how, in accordance with a desired printing pattern, a covering layer 3 can be applied to a screen 1. To this end, the screen 1, which is a flat screen here, is first laid onto a flat support 2 and fastened or fixed to it in a suitable way. The application of the covering layer 3 to the screen 1 is effected with the aid of a transferring printing roll 4, which is previously appropriately coated with covering material 5, as defined by a pattern. If the covering roll 4 is arranged to be stationary and is allowed to rotate about its longitudinal axis 6, then during the movement of the support 2 in the direction of the arrow 7 the covering material 5 can be pressed into the screen 1, with the result that the covering layer 3 is produced. In this case, the support 2 prevents any penetration of the covering material 5 through the screen 1, which leads to a more precise pattern formation.

The coating of the transfer-printing roll 4 with covering material 5 is effected in a manner that is generally known and will not be explained in more detail here. Mention should only be made of the fact that it would also be possible for the transfer-printing roll 4 to move in relation to a stationary support, where the roll moves on a stationary screen 1.

Instead of by means of a transfer-printing roll 4, the covering layer 3 could also be sprayed, for example, onto the flat screen 1. To this end, a spray head could be guided parallel to the surface of the screen 1 and along a serpentine path. The spray head could be controlled and defined by a pattern in accordance with spraying signals for the application of liquid covering material to the screen 1.

Figure 3:
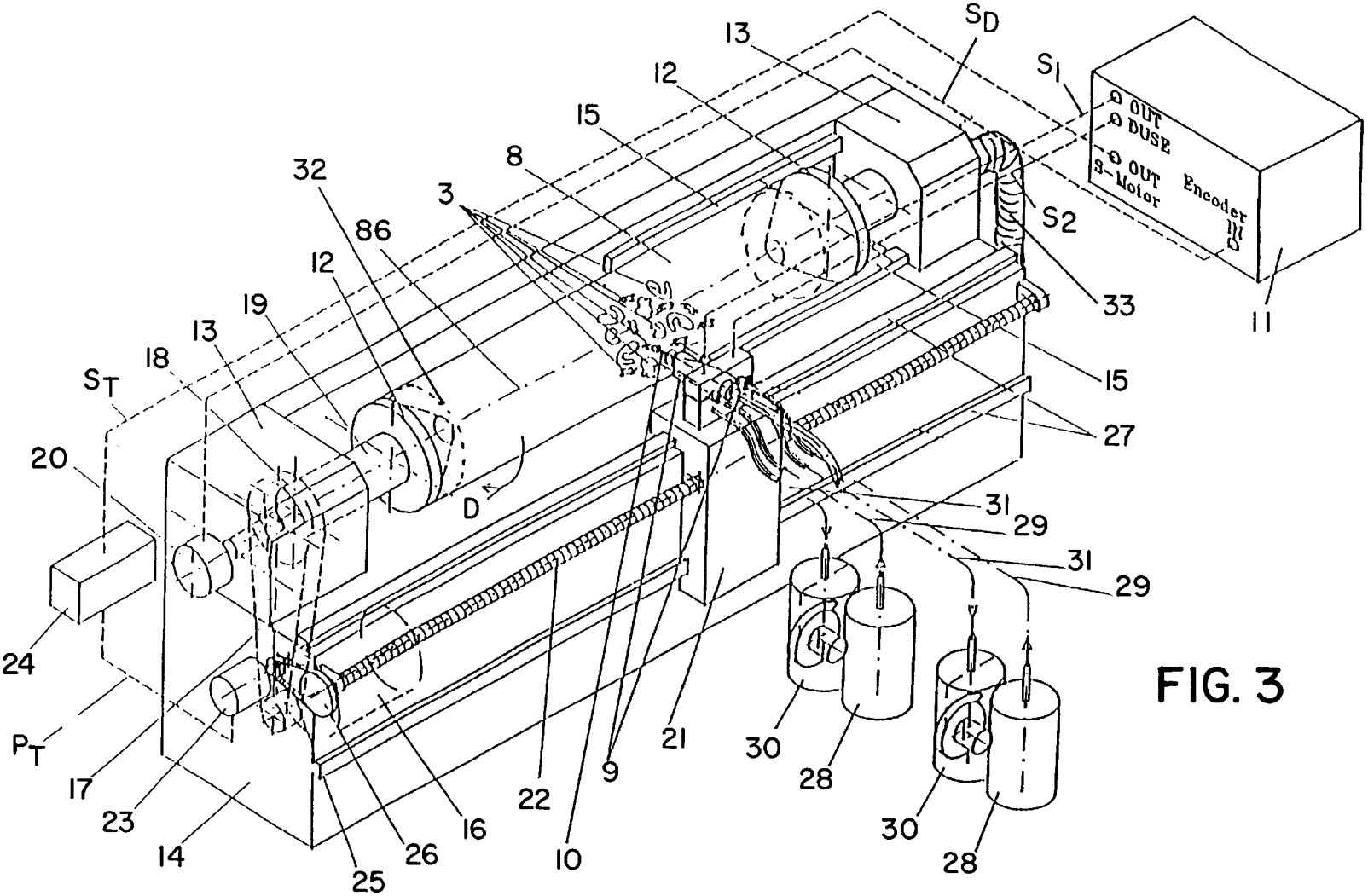
FIG. 3 shows a device for applying a covering layer to the outer circumferential surface of a cylindrical screen.

FIG. 3 shows a further embodiment for carrying out the method according to the invention, where a covering layer may be applied to a cylindrical screen.

Reference symbol 8 denotes a rotating screen in cylindrical form, onto which paint or lacquer, wax or a metal alloy is applied as the covering liquid through one or more nozzles 9. In this case, a jet 10 of the covering liquid, which is sprayed out of the nozzles 9, is controlled by means of a computer 11 in such a way that the covering liquid is applied only to those points on the screen 9 at which the screen 8 must be covered, as defined by a pattern. For this purpose, the screen 8 is accommodated between two synchronously driven end heads 12 and set rotating (direction of rotation D). In order to accommodate different stencil lengths or screen lengths between the end heads 12, the right-hand ends head 12, for example, is displaceable in the direction of the cylinder axis of the round screen 8. The screen 8 is placed between the right-hand and the left-hand end head 12, and the right-hand end head 12 is moved up against the screen 8. The screen 8, which is normally configured to be very thin and light, can under certain circumstances already be set rotating by the axially acting clamping force and the friction between screen 8 and the left-hand, driven end head 12. The stiffness of the screen 8 is also always adequate to contribute to the angular momentum of the right-hand end head 12 via frictional forces provided that the rotational speed of the screen 8 is increased slowly so that the required acceleration torque does not overtax the transmission capacity of the round screen 8. The two end heads 12 are rotatably mounted on bearing blocks 13. The bearing blocks 13 are arranged on a machine bed 14. In order to guide the right-hand bearing block 13 in FIG. 3, there are guide rods 15 which, for example, can be fastened to the machine bed 14.

The left-hand end head 12 is driven by a motor 16 and a belt 17. This belt 17 wraps around a drive wheel 18, which is located fixedly on an axle 19 which carries the left-hand end head 12. At the other end of the axle 19 there is an incremental pulse encoder 20, which determines the rotational position of the axle 19 or of the screen 8 and outputs corresponding signals SD to the computer 11. At the same time, the nozzles 9, which are fastened to a machining table 12, are slowly displaced in the direction of the cylinder axis 8*b* of the screen 8, with the result that a thin jet, which is separated into drops and consists of covering liquid, and which emerges from the nozzles 9, impinges on the screen 8 along a helical line of very low pitch. In the case of several nozzles being arranged in the longitudinal direction of the cylinder axis 8*b*, section-by-section coating of the screen 8 with covering material may also be effected. In such an embodiment, the row of nozzles are offset by an amount corresponding to its length after each circumferential revolution of the screen cylinder 8, and so on. The machining table 21 has its advance motion imparted to it via a spindle 22. The spindle 22 is driven via a stepping motor 23, which receives its stepping signals $S_T$ also from the computer 11. These stepping signals $S_T$ are converted into power pulses $P_T$ by a driver stage 24. The rotation of the motor axle of the stepping motor 23 is transmitted to the spindle 22 via a belt 25 and a pulley 26. The spindle projects through the machining table 21. The machining table 21 is guided on guide rails 27 on the machine bed.

The nozzles 9 are in each case assigned a control signal $S_1$, $S_2$ by the computer 11, in order to spray out covering liquid when a control signal is received.

The nozzles 9 have to be supplied with a covering liquid that is suitable for the printing operation. To this end, they are connected to small pressure containers 28 via supply lines 29. In the pressure containers 28, the covering liquid is under a low positive pressure of about 1 to 5 bar. Expediently, a separate pressure container 28 will be provided for each nozzle 9, since differences in the lines resistances and the need to be able to control the quantity applied per nozzle 9 necessitate different output pressures of the covering liquid. A quantity of unused covering liquid also accumulates at each nozzle 9, and has to be continuously sucked away and conveyed back. To this end, negative pressure tanks 30 are provided, into which the unused covering liquid is conveyed back, via return lines 31, by means of the negative pressure prevailing in these tanks. After conditioning, the recirculated covering liquid can once more be fed to the application process as the covering liquid.

The covering liquid can be applied in very small droplets, in order to achieve a sufficiently high resolution power when producing the printing pattern on the surface of the screen 8. Here, the liquid can have a high viscosity, in order to be able to entrain an adequate proportion of a solid substance, given a relatively small droplet size. However, it is also possible for several liquid components to be sprayed on separately through various nozzles and to be combined in one pint on the surface of the screen 8. Here, these may be different epoxy resin components, which are only converted into a gel state when a cross-linking reaction has been started after they have met. Furthermore, the endeavor is to achieve a high droplet frequency in this method.

High droplet frequency is, for example, possible by means of electrostatically acting nozzles, in which a liquid jet is caused to break up into droplets by means of a very high-frequency oscillation, for example of a tube wall, and in which the droplets are subsequently electrically charged and deflected or not deflected in an electrostatic field, depending on their charge state.

In order to prevent the penetration of the applied droplets through the screen 8, there is in the interior or the screen 8 a cylinder support 32, which rests on the inner circumferential surface of the screen 8 and closes the screen openings.

This cylindrical support 32 may be, for example, a rubber tube of appropriate length, which has previously been introduced into the screen 8 and inflated, before the screen 8 was placed between the end heads 12.

However, the cylindrical support 32 may also be a metallic and very thin-walled sleeve. On such a sleeve, the screen 8 is first placed. Subsequently, the screen with the sleeve is placed onto the end heads 12. If a positive pressure is then produced within the cylindrical sleeve 32, the sleeve then expands slightly in the radial direction and hence closes the openings in the screen 8. In order to produce a positive pressure in the interior of the sleeve 32 or of the screen 8, it is possible, for example, for the right-hand end head 12 to be connected to a pressure hose 33, via which a gaseous medium under positive pressure is blown in. The positive pressure is generated by a pressure generator connected to the other end of the pressure hose 33. This pressure generator may be, for example, an appropriately designed blower which is able to supply air under positive pressure in a sufficient quantity.

It should be pointed out that, using the device according to FIG. 3, it is of course not only cylindrical screens that can be provided with a covering layer. It is likewise also possible for hollow cylinders, which are thin-walled and have a closed covering surface, to be mounted on the end head 12. The generation of a positive pressure in the interior of these hollow cylinders would then lead to more stable concentric running of these cylinders.

In this case, for example, where a thin-walled metal cylinder may be employed which carries on its outer surface a photoelastomer layer that is coated with the aid of the nozzles. However, it would also be possible to employ only a thin-walled metal cylinder, which is to be coated with a covering layer, in order to apply a metal layer to it by electroplating at the points where there is no covering layer. In this way, it would also be possible to produce screen-printing cylinders from nickel, for example.

It is of course not absolutely necessary for the coating of the cylinders to be applied with the aid of the nozzles 9 in FIG. 3. The device according to FIG. 3 could also have a transfer-printing roll located parallel to the axis 8*b*, in order to transfer the desired printing pattern to the hollow cylinder located between the end heads 12, using the transfer-printing roll.

Alternatively, the nozzles in FIG. 3 could also be replaced by a spreading device for spreading covering liquid onto the outer circumferential surface of the hollow cylinder.

Figure 4:
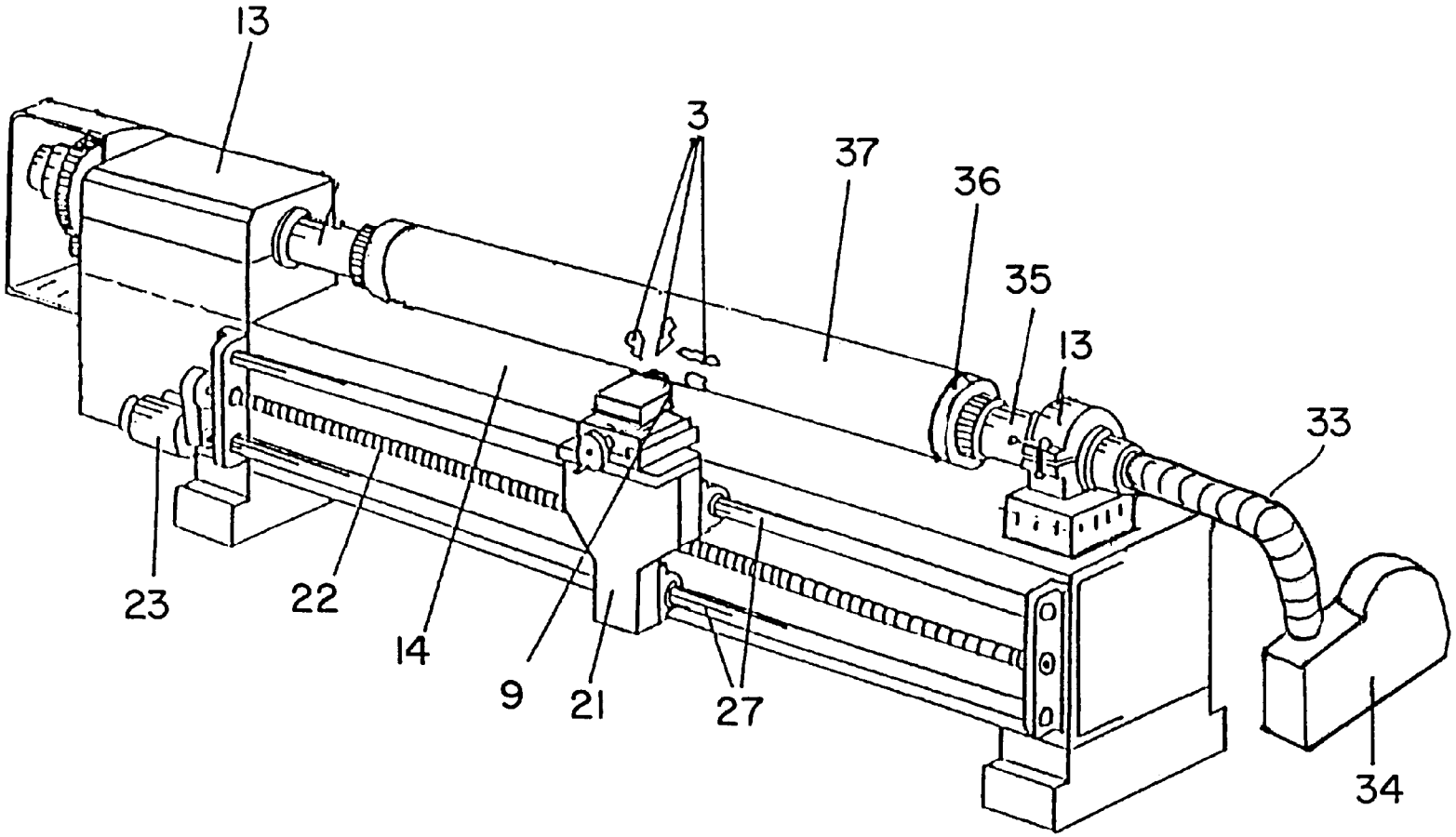
FIG. 4 shows a further embodiment for applying a covering layer to the outer circumferential surface of a hollow cylinder with a closed surface, which is seated on a stencil clamping roll

A further exemplary embodiment of a device for carrying out the method according to the invention is shown in FIG. 4. Parts identical to those in FIG. 3 are in this case provided with the same reference symbols and will not be described again.

In the present case, a continuous shaft 35 is rotatably mounted on the bearing blocks 13. Drawn over this shaft 35 is an inflatable rubber tube 36, which can be inflated with the aid of a blower 34, using compressed air or another suitable gaseous medium. To this end, the blower 34 is connected to the rubber tube 36 via a pressure hose 33 and via an internal bore in the shaft 35.

If the rubber tube 36 is evacuated, a hollow cylinder 37 that is to be printed can be drawn over it. This cylinder may be a screen cylinder or one that has a closed covering surface, as has already been described. After the hollow cylinder 37 has been drawn onto the rubber tube 36, the latter is inflated, with the result that it makes close contact with the inner circumferential surface of the hollow cylinder 37 and keeps the latter round or stabilizes it in concentric running. If the hollow cylinder 37 is a screen cylinder, then at the same time, the screen openings are closed from the inside or from behind by the rubber tube 36.

It is now possible, as already described at the beginning, for a covering layer 3 to be applied to the outer circumferential surface of the hollow cylinder 37 as defined by a pattern with the aid of the nozzles 9. In the case of a screen cylinder, the rubber tube is located under it preventing the penetration through the screen of the liquid covering material for forming the covering layer 3.

Instead of the nozzles 9, a transfer-printing roll or a coating device for spreading liquid onto the hollow cylinder 35 can be employed.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A method of producing a screen-printing stencil comprising the steps of:

providing a cylinder support device having a solid surface;

placing a substantially cylindrical screen on the cylinder support device;

producing a positive pressure within the cylinder support device to block passage of screen-printing material through apertures in the screen with the solid surface of the cylinder support device;

applying a layer of screen-printing material in accordance with a predetermined pattern covering predetermined areas; and filling apertures in the substantially cylindrical screen with the screen-printing material;

whereby printing patterns formed by the substantially cylindrical screen and screen-printing material have substantially increased modeling ability which in turn substantially increases printing quality.

2. The method of claim 1, further comprising the step of separating the cylinder support device from the screen.

3. The method of claim 2, further comprising the step of solidifying the screen-printing material prior to separating the cylinder support device from the screen.

4. The method of producing a screen-printing stencil according to claim 2, wherein the step of separating the cylinder support device from the screen includes the step of evacuating fluid from the cylinder support device.

5. The method of claim 1, wherein the step of applying a layer of screen-printing material includes the step of spraying the screen-printing material onto the screen.

6. The method of producing a screen-printing stencil according to claim 5, further comprising the steps of:

providing tanks containing screen-printing material;

providing at least one negative pressure tank; and providing at least one nozzle; wherein the step of spraying the screen-printing material onto the substantially cylindrical screen includes the steps of:

forcing the screen-printing material out of the at least one nozzle under positive pressure; and sucking unused screen-printing material into the at least one negative pressure tank.

7. The method of claim 1, wherein the step of applying a layer of screen-printing material includes the step of spreading the screen-printing material onto the screen.

8. The method of claim 1, wherein the step of applying a layer of screen-printing material includes the step of applying the screen-printing material onto the screen by a transfer-printing process.

9. The method of claim 1, wherein the step of applying a layer of screen-printing material includes the step of applying the screen-printing material onto the screen by at least one of a doctoring and a dipping process.

10. The method of claim 1, wherein the step of providing a cylinder support device having a solid surface further includes the step of providing a cylinder support device which is substantially rigid.

11. The method of claim 1, wherein the step of providing a cylinder support device having a solid surface further includes the step of providing a cylinder support device which is substantially elastic.

12. The method of claim 1, wherein the substantially cylindrical screen includes a first side opposable to a screen-printing material applicator and a second side facing the cylinder support device, the step of producing a positive pressure including the step of pressing the support device against the second side of the screen.

13. The method of claim 1, the step of producing a positive pressure including the step of increasing the volume of the cylinder support device.

14. The method of producing a screen-printing stencil according to claim 1, wherein the step of providing a cylinder support device includes the step of providing an elastic hollow body.

15. The method of producing a screen-printing stencil according to claim 1, wherein the step of providing a cylinder support device includes the step of providing a rubber tube.

16. A method of producing a screen-printing stencil comprising the steps of:

providing a cylinder support device having an exterior surface;

providing a substantially cylindrical screen having an interior surface;

placing the substantially cylindrical screen on the cylinder support device;

increasing the volume of the cylinder support device by producing a positive pressure within the cylinder support device, until the exterior surface of the cylinder support engages the interior surface of the substantially cylindrical screen; and applying a layer of screen-printing material to the substantially cylindrical screen in a pattern on the screen, the screen-printing material filling apertures in the substantially cylindrical screen.

17. The method of producing a screen-printing stencil according to claim 16, further comprising the step of disengaging the exterior surface of the cylinder support device from the interior surface of the substantially cylindrical screen.

18. The method of producing a screen-printing stencil according to claim 17, further comprising the step of solidifying the screen-printing material prior to disengaging the respective surfaces.

19. The method of producing a screen-printing stencil according to claim 17, wherein the step of disengaging the exterior surface of the cylinder support device from the interior surface of the substantially cylindrical screen includes the step of evacuating fluid from the cylinder support device.

20. The method of producing a screen-printing stencil according to claim 16, the step of applying a layer of screen-printing material including the step of spraying the screen-printing material onto the substantially cylindrical screen.

21. The method of producing a screen-printing stencil according to claim 20, further comprising the steps of:

providing tanks containing screen-printing material;

providing at least one negative pressure tank; and providing at least one nozzle; wherein the step of spraying the screen-printing material onto the substantially cylindrical screen includes the steps of:

forcing the screen-printing material out of the at least one nozzle under positive pressure; and sucking unused screen-printing material into the at least one negative pressure tank.

22. The method of producing a screen-printing stencil according to claim 16, wherein the step of applying a layer of screen-printing material includes the step of spreading the screen-printing material onto the substantially cylindrical screen.

* * * * *